US005568875A

United States Patent [19]

Johnson et al.

[11] Patent Number: 5,568,875

[45] Date of Patent: Oct. 29, 1996

[54] BULK BALLOON HANGER

[75] Inventors: J. Edward Johnson, 5205 15th St., Lubbock, Tex. 79416; Tom Gabhart, Huntingburg, Ind.

[73] Assignee: J. Edward Johnson, Lubbock, Tex.

[21] Appl. No.: 441,456

[22] Filed: May 15, 1995

[51] Int. Cl.[6] ..... A47F 5/01

[52] U.S. Cl. ..... 211/113; 446/220

[58] Field of Search ..... 211/113, 124, 211/89; 223/88, 96; D6/326; 446/220, 222

[56] References Cited

U.S. PATENT DOCUMENTS

| | | | |
|---|---|---|---|
| D. 295,579 | 5/1988 | Arnold | D6/326 X |
| 352,046 | 11/1886 | Crommer . | |
| 1,112,775 | 10/1914 | Crutcher . | |
| 1,143,693 | 6/1915 | Down | 211/89 |
| 2,104,305 | 1/1938 | Marble | D6/326 X |
| 2,312,369 | 3/1943 | Solecki | 446/220 |
| 2,882,645 | 4/1959 | Stivers | 446/220 |
| 2,931,133 | 4/1960 | Dodson | 446/222 |
| 3,092,388 | 6/1963 | Wagenheim | 446/220 X |
| 3,118,542 | 1/1964 | Lewis | 211/89 |
| 4,177,908 | 12/1979 | Batts et al. | 223/96 |
| 4,556,158 | 12/1985 | Blanchard et al. | 223/88 |
| 4,619,385 | 10/1986 | Lessard | 223/96 |
| 4,936,532 | 6/1990 | Williams | 248/205.3 |
| 5,024,011 | 6/1991 | Collins | 446/220 X |
| 5,035,391 | 7/1991 | Steele et al. | 446/220 X |
| 5,137,191 | 8/1992 | Blanchard et al. | 223/88 |
| 5,282,930 | 2/1994 | Lang | 446/220 X |

*Primary Examiner*—Ramon O. Ramirez
*Assistant Examiner*—S. Snapp
*Attorney, Agent, or Firm*—Jacobson, Price, Holman & Stern, PLLC

[57] ABSTRACT

A bulk balloon hanger for effectively supporting and displaying a plurality of noninflated mylar balloons. The bulk balloon hanger includes a hook for engaging a support rod or bar or other supporting structure, a curved bar having a permanent but slight bow effect along its length together with a straight channel along the length of the bar and a tension rod pivoted at one end of the bar and a hook-like clasp at the other end of the bar that engages the free end of the tension rod when the tension rod grips a plurality of noninflated mylar balloons between the tension rod and channel in the bowed or curved bar thereby providing an effective support for a plurality of noninflated mylar balloons.

13 Claims, 2 Drawing Sheets

BULK BALLOON HANGER

BACKGROUND OF THE INVENTION

1. Field of the Invention

The present invention generally relates to a bulk balloon hanger for effectively supporting and displaying a plurality of noninflated mylar balloons. The bulk balloon hanger includes a hook for engaging a support rod or bar or other supporting structure, a curved bar having a permanent but slight bow effect along its length together with a shallow channel along the length of the bar and a tension rod pivoted at one end of the bar and a hook-like clasp at the other end of the bar that engages the free end of the tension rod when the tension rod grips a plurality of noninflated mylar balloons between the tension rod and channel in the bowed or curved bar thereby providing an effective support for a plurality of noninflated mylar balloons.

2. Description of the Prior Art

Balloons constructed of thin mylar material provided with colorful messages and designs printed on the external surfaces thereof have become quite popular and represent a considerable portion of balloon sales. The balloons are generally made from a thin mylar material which is strong enough to hold the pressure required for inflation with helium or air and yet light enough to float freely. Also, the mylar material is easily heat sealed for fabrication versatility, is very durable and can be readily printed. However, the mylar material is relatively flimsy and includes extremely slick surface areas thus making them very difficult to display or store effectively prior to inflation as they tend to become disarrayed when handled. Also, there are a tremendous number of various shapes, sizes and styles of balloons that a balloon store normally will carry as inventory thus aggravating the problem of storage, organization and display.

While various types of hangers have been provided for supporting and displaying various items to enable purchasers to see and touch the items being displayed, previously known display hangers have not utilized the structure of this invention which enables a plurality of noninflated mylar balloons to be supported from a uniquely constructed hanger for gripping and retaining a plurality of noninflated mylar balloons in order to support the balloons in a position for observation by potential purchasers and to enable quick and easy access to the balloon to be delivered to a purchaser.

SUMMARY OF THE INVENTION

An object of this invention is to provide a bulk balloon hanger including a curved bar provided with a lengthwise channel with the bar and channel having rounded contiguous surfaces defining the channel combined with a pivotal tension rod having one end loosely pivoted to the curved bar at one end thereof and the other end of the tension rod being releaseably engaged with a hook-type clasp which enables the free end of the tension rod to be selectively released to move to an open position and selectively clamp or release a plurality of noninflated mylar balloons between , the rod and the bar.

A further object of the invention is to provide a bulk balloon hanger as described in the preceding object in which the curved bar includes a lengthwise, shallow arcuate bowed configuration forming the structure for supporting the straight tension rod with the surface of the curved bar facing the tension rod including a continuous longitudinal groove or channel which can partially receive the tension rod and the channel in the bowed surface of the bulk balloon hanger which enables the straight tension rod constructed of substantially rigid but somewhat flexible and resilient material to securely grip and retain a plurality of mylar balloons supported between the bar and tension rod.

These together with other objects and advantages which will become subsequently apparent reside in the details of construction and operation as more fully hereinafter described and claimed, reference being had to the accompanying drawings forming a part hereof, wherein like numerals refer to like parts throughout.

DESCRIPTION OF THE PREFERRED EMBODIMENT

Figure 2:
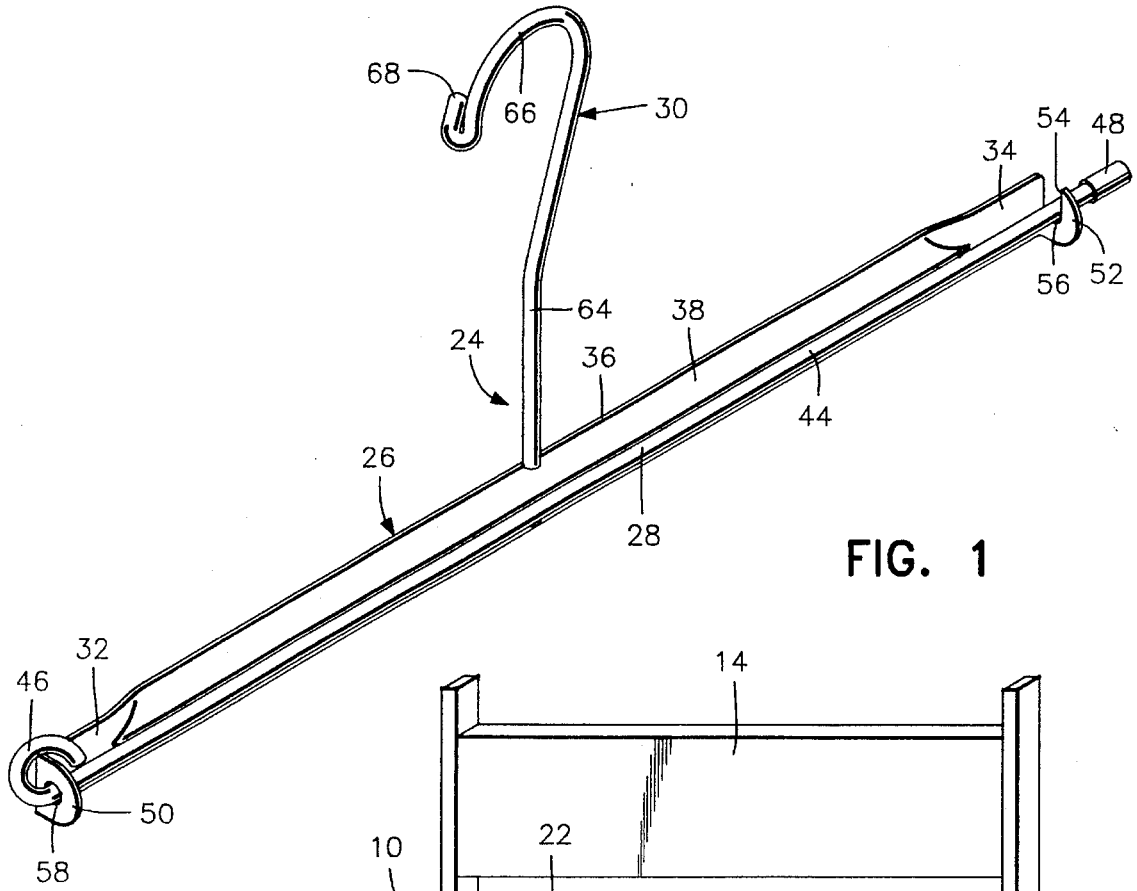
FIG. 2 is a perspective view of the hanger for uninflated mylar balloons.
Figure 1:
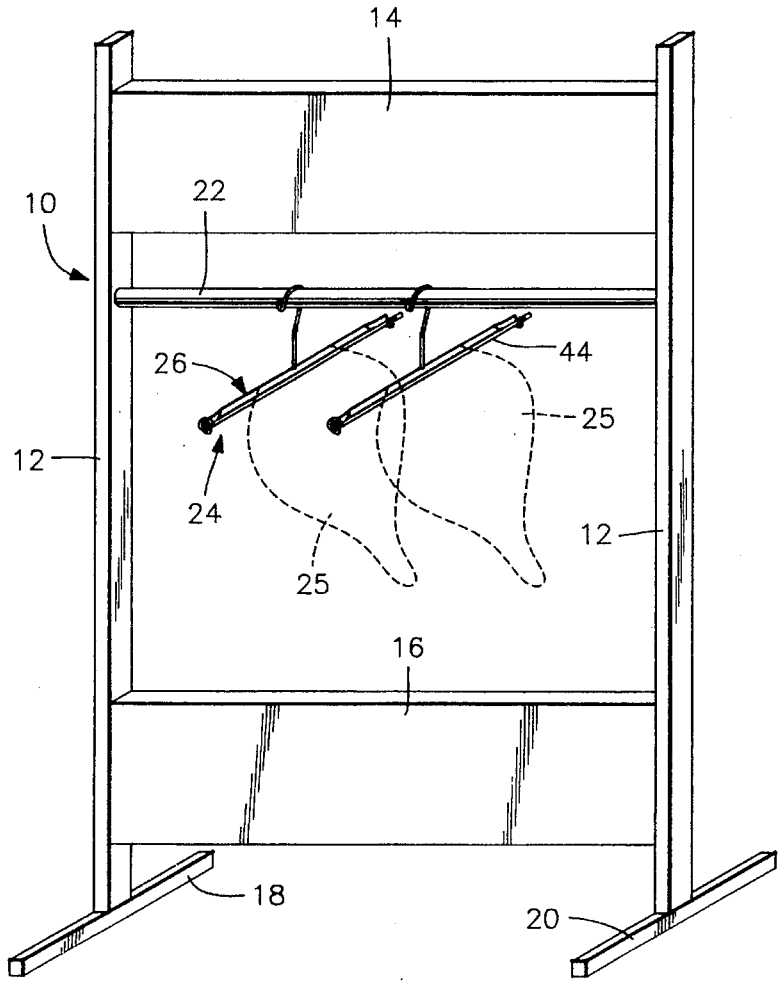
FIG. 1 is a perspective view of a display rack illustrating a plurality of bulk balloon hangers supported from the rack and supporting uninflated mylar balloons.

FIG. 1 illustrates a supporting and display rack generally designated by reference numeral 10 which includes a frame defined by vertically extending parallel side members 12 interconnected by top and bottom members 14 and 16 and horizontally disposed support members 18 and 20 which are rigidly connected to the lower ends of the side members 12 and extending in opposite directions to stably support the rack on a support surface. The connecting members 14 and 16 may be in the form of panels provided with advertising or descriptive indicia if desired. Also, one or more transverse supporting rods 22 interconnect the side members to form a support for a plurality of bulk balloon hangers generally designated by reference numeral 24. Each of the bulk balloon hangers 24 effectively supports, displays, organizes and stores a plurality of uninflated mylar balloons 25 which have various messages or designs printed on the external surfaces thereof and which have very slick surfaces which are difficult to grippingly support.

The bulk balloon hanger 24 includes three components which include a curved bar generally designated by reference numeral 26, a tension rod generally designated by reference numeral 28 and a hook generally designated by reference numeral 30.

Figure 3:
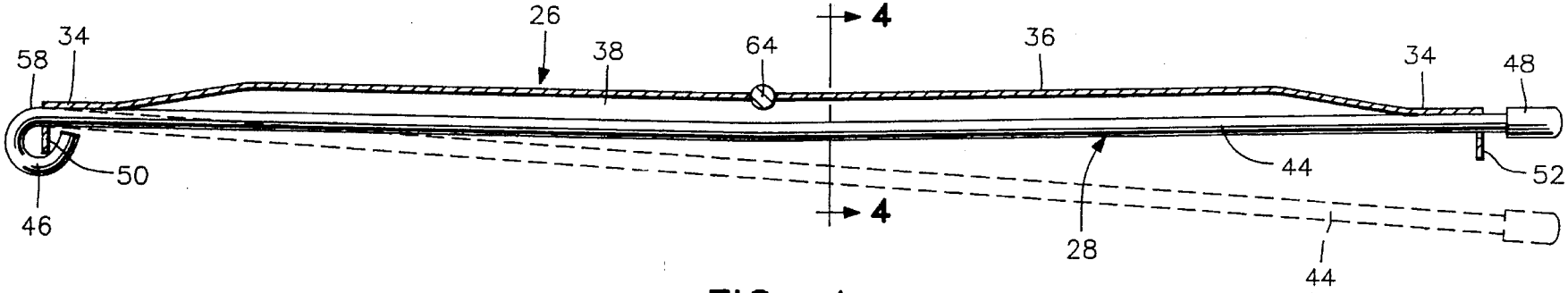
FIG. 3 is a longitudinal sectional view of the hanger illustrating the relationship of the tension rod, the curved bar and the channel in the curved bar with the released position of the bar being shown in broken lines.
Figure 4:
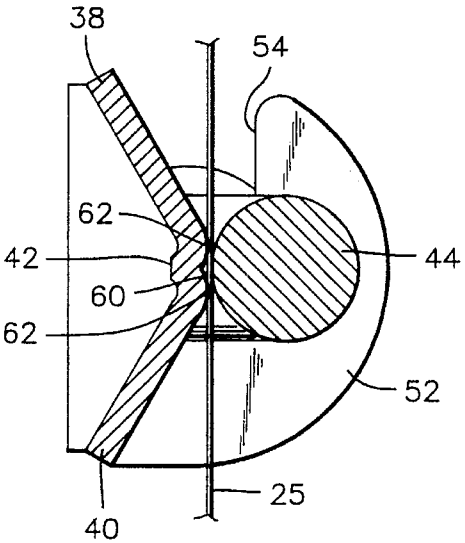
FIG. 4 is a transverse, sectional view, on an enlarged scale, taken along section line 4—4 on FIG. 3 illustrating further structural details of the curved bar, groove and the tension rod engaging a plurality of mylar balloons and biasing the balloons against the curved or bowed bar.

The curved bar 26 is in the form of a stiff, substantially rigid member of metal, plastic or other generally rigid material. The bar 26 includes generally vertical, flat ends 32 and 34 which are relatively short in length. Extending between the end 32 and 34 is a longitudinally elongated central bowed portion 36 which includes upper and lower flanges 38 and 40 and a central portion 42 defining a longitudinal axis of the bowed portion 36 as illustrated in FIG. 4 with the flanges 38 and 40 being inclined laterally from the central portion 42. Also, as illustrated in FIG. 3, the central portion 36 is arcuately bowed to a slight degree from end to end with the center of the bowed portion 36 of the curved bar being displaced approximately ¼ inch laterally in relation to the flat ends 32 and 34. The outer end portions of the flanges 38 and 40 smoothly merge into the flat end portions 32 and 34.

The tension rod 28 is a substantially rigid elongated straight rod 44 of circular cross sectional configuration constructed of spring steel, plastic or the like and having a reversely bent loop 46 on one end thereof and a protective resilient ferrule 48 on the other end thereof. The curved bar 24 includes a laterally extending tab or lug 50 on the flat end portion 32 and a laterally extending flat hook 52 on the flat end portion 34 with the hook 52 including an entrance opening 54 and a shallow notch or recess 56 which faces inwardly to enable the rod 44 to be moved upwardly or downwardly through the opening 54 and to be retained in engagement with the hook 52 by engagement in the lateral recess or notch 56. The straight rod 44 thus extends from the aperture 58 in the lug 50 which is engaged by the loop 46 to the notch 56 and the hook 52. As indicated the central portion 36 has its central area offset toward the rod to an extent that in order engage the free end of the rod with the hook 52, it is necessary to engage the rod with the bowed central portion 36 of the bar and actually flex or partially bend the rod to engage the free end portion of the rod with the hook. Thus, there is a frictional contact between a substantial lengthwise portion of the rod and a substantial facing and opposed lengthwise surface of the curved bar 26 with this contacting engagement being illustrated in FIG. 4 along with the curvature of the rod 44 from its loop end towards the portion which engages the hook 52. This provides for a gripping engagement of a plurality of uninflated mylar balloons 25 in a manner that they will be securely supported in a suspended or depending relation to the hanger 24.

To further enhance the gripping engagement, the surface of the curved bar which faces the tension rod 44 is provided with a longitudinally extending indentation or channel 60 which partially receives the periphery of the rod 44 when engaged therewith but which also provides gripping edges 62 above and below the channel 60 thereby providing two gripping edges on the surfaces of an uninflated mylar balloon formed by the gripping surfaces 62 and opposing gripping surfaces on the opposite side of a mylar balloon defined by spaced circumferential, longitudinally extending portions of the rod 44 thereby effectively supporting a plurality of uninflated mylar balloons in secure gripping engagement by the curved bar 24 and the tension rod 44 with the balloons being readily accessible by disconnecting the free end of the tension rod 44 from the hook 52 to remove a selected balloon or balloons or to add additional balloons to the display by inserting a plurality of balloons between the curved bar 24 and the tension rod 44 when in its released and outwardly pivoted position after which the tension rod 44 is pivoted into clamping engagement with the mylar balloons and latched in the clamping position.

The hook 30 includes a shank 64 having its lower end welded to top and bottom edge portions of the flanges 38 and 40 in partially intersecting relation thereto. The upper end of the shank includes a reversely curved hook 66 having a reversely bent free end 68 to engage and be supported by the supporting rod 22 on the rack or stand 10 as illustrated in FIG. 1.

The curved bar 24 provides a permanent bow effect along its length and provides a bowed seating channel along the same length which receives and stabilizes the tension rod 44 and enables the tension rod to provide the necessary tension and gripping effect required to secure a single or a plurality of mylar balloons between the curved bar 24 and the tension rod 44. The loop 46, tab 50 and aperture 58 oriented closely adjacent flat end 32 provides a pivotal coupling of the tension rod to the curved bar which enables the tension rod to move freely in substantially any pivotal direction. However, when the tension rod is engaged with the hook 52 from the broken line position in FIG. 3, it follows the bow in the curved bar and seats itself as it closes into the seating channel as the other end of the tension rod 44 is secured to the opposite end of the curved bar 24 by engagement with the hook 52. This operation accomplishes two significant results which are unique in this invention. Initially, the straight tension rod is deformed uniformly along the length of the curved bar 24 providing the tension required to grip and hold in place a stack of several mylar balloons. Secondly, additional gripping of the mylar balloons is achieved by the combination of the transversely concave seating channel 60 on the curved bar and the cylindrical peripheral surface of the tension bar 44 which creates a serpentine pattern in the mylar balloons at the point of contact between the gripping surfaces 62 defined by the channel 60 and the circumferentially spaced contact points on the tension rod 44 thereby substantially increasing the surface area of the mylar balloons captured between the tension rod 44 and the curved bar 24. By the use of this invention, a merchandiser can select any style, shape or size of mylar balloons in bulk, usually from 10 to 30 balloons and hang them on a merchandising rack 10 where they can be effectively displayed, conveniently stored and properly organized for enhancing the merchandising of the balloons.

The foregoing is considered as illustrative only of the principles of the invention. Further, since numerous modifications and changes will readily occur to those skilled in the art, it is not desired to limit the invention to the exact construction and operation shown and described, and, accordingly, all suitable modifications and equivalents may be resorted to, falling within the scope of the invention.

What is claimed as new is as follows:

1. A bulk balloon hanger comprising an elongated bar, an elongated clamping rod oriented for contact with the longitudinal extent of the bar, means hingedly connecting one end of the rod to one end of the bar, means detachably connecting the other end of the rod to the other end of the bar, a support on a central portion of the bar for engagement with a supporting member, said bar including a central portion bowed toward said rod for clampingly receiving a plurality of uninflated mylar balloons securely gripped between the bowed curved bar and said rod.

2. The hanger as defined in claim 1 wherein said bar includes flat, aligned end portions interconnected by an elongated bowed portion, said rod being normally straight and having the end portions thereof connected to the bar laterally inwardly in relation to a longitudinal plane oriented tangential to the central bowed portion whereby the rod will be biased into a bowed configuration conforming with and cooperating with the bar to securely grip a plurality of uninflated mylar balloons.

3. The hanger as defined in claim 2 wherein said central bowed portion includes a longitudinal groove defining a recess for partially receiving and being engaged by said rod and adapted to engage the mylar balloons at multiple longitudinally extending gripping areas in opposed relation to circumferentially spaced areas on said rod.

4. The hanger as defined in claim 1 wherein said bowed portion of the bar is defined by upper and lower flanges extending upwardly and downwardly from a longitudinal central axis, said flanges being inclined away from a vertical plane containing said central axis, said bar including flat end portions extending longitudinally from the ends of said bowed central portion, each end portion including a laterally extending tab, said means hingedly connecting one end of the rod to the bar including an aperture in the tab closely adjacent one flat end portion, said aperture receiving an eye loop on the end of the rod, said means detachably connecting the other end of the rod to the bar including a hook shaped notch in the tab on the other end of the bar closely adjacent the other flat end portion for biasing the rod toward the bowed central portion to deform the rod from a straight configuration into a bowed configuration for securely clamping the balloons between the bar and rod.

5. The hanger as defined in claim 4 wherein a shallow longitudinal groove is formed in said bowed portion between said flanges to partially receive said rod and form longitudinally extending griping areas spaced circumferentially of said rod.

6. The hanger as defined in claim 5 wherein said bar support is an upwardly extending hook adapted to engage a horizontal support member.

7. The hanger as defined in claim 6 wherein said hook has a shank rigidly secured to the top and bottom edges of said bar.

8. The hanger as defined in claim 1 wherein said bowed central portion has a convex/concave cross sectional configuration for rigidifying said bar longitudinally.

9. A support for a thin flexible member having smooth external surfaces, said support comprising a supported elongated bar having a shallow convexly curved longitudinal surface area oriented generally horizontally to engage an external surface of a thin flexible member oriented in a vertical position and a normally straight clamping rod extending throughout the length of the convexly curved surface area on said bar, said straight clamping rod engaging the external surface of the thin flexible member in opposed relation to the convexly curved surface area on said bar, the ends of said clamping rod being connected to said bar at end points laterally inwardly of an apex of the convexly curved surface area to bias the straight clamping rod into a convexly curved rod biased toward the convexly curved surface area on said bar for securely clamping the thin flexible member between the convexly curved surface area and convexly biased clamping rod.

10. The support as defined in claim 9 wherein said curved longitudinal surface area on the bar includes a longitudinal shallow recess partially receiving said rod and forming spaced longitudinal gripping areas between the rod and bar to more securely clamp said thin flexible member.

11. The support as defined in claim 10 wherein said bar is supported by a central upwardly extending hook.

12. The support as defined in claim 9 together with a plurality of additional thin flexible members in the form of a plurality of uninflated mylar balloons.

13. The support as defined in claim 9 wherein said bar is substantially rigid and permanently formed as a curved member, said rod being a resilient, substantially rigid member deformable to conform with and engage the curved longitudinal surface area on said bar substantially throughout its length.

* * * * *